United States Patent [19]

Pater

[11] 4,353,466

[45] Oct. 12, 1982

[54] SLOTTED SUPPORT LOGS FOR SHEET SHIPPING CONTAINERS

[75] Inventor: Walter E. Pater, New Kensington, Pa.

[73] Assignee: PPG Industries, Inc., Pittsburgh, Pa.

[21] Appl. No.: 187,879

[22] Filed: Sep. 17, 1980

[51] Int. Cl.[3] ..... B65D 85/48

[52] U.S. Cl. ..... 206/453; 206/454; 206/460; 206/586; 206/813; 206/448

[58] Field of Search ..... 206/460, 454, 453, 586, 206/813, 448

[56] References Cited

U.S. PATENT DOCUMENTS

| | | | |
|---|---|---|---|
| 1,881,293 | 10/1932 | Poirier et al. | 206/460 |
| 2,919,022 | 12/1959 | Lidgard | 206/62 |
| 3,414,124 | 12/1968 | Lidgard | 206/62 |
| 3,459,297 | 8/1969 | Templeton et al. | 206/460 |
| 3,566,562 | 3/1971 | White | 206/460 |
| 4,018,643 | 4/1977 | Leving | 206/460 |
| 4,050,579 | 9/1977 | Gorski et al. | 206/460 |
| 4,053,049 | 10/1977 | Beauvais | 206/460 |

FOREIGN PATENT DOCUMENTS

| | | | |
|---|---|---|---|
| 2833444 | 2/1979 | Fed. Rep. of Germany | 206/460 |
| 1127584 | 4/1956 | France | 206/460 |
| 26878 | of 1913 | United Kingdom | 206/460 |

*Primary Examiner*—Joseph Man-Fu Moy
*Attorney, Agent, or Firm*—Donald Carl Lepiane

[57] ABSTRACT

A container for shipping automotive windshields in a generally vertical position has a pair of spaced logs mounted on the base. Each of the logs has an elongated member having an adhesive strip on a longitudinally extending sheet edge supporting surface and a row of recesses on each side of the strip. The windshields are urged toward the adhesive strip and held in continuous contact therewith by a spacer assembly and strap to prevent longitudinal and lateral motion of the windshields during shipment of the loaded container. The spacer assembly includes a plurality of spacers each having a recess for receiving upper edge portions of the loaded windshield and a tab portion or second recess for aligning each of the spacers by an elongated member. The windshields are secured in the container and continuously biased against the adhesive strip by the strap.

15 Claims, 7 Drawing Figures

SLOTTED SUPPORT LOGS FOR SHEET SHIPPING CONTAINERS

BACKGROUND OF THE INVENTION

1. Field of the Invention

This invention relates to slotted logs for securing sheets, e.g. automotive lites in shipping and/or handling containers and to a method of securing sheets in a container.

2. Description of the Technical Problems

U.S. Pat. Nos. 2,919,022 and 3,414,124 teach a container for handling and/or storing automotive lites, e.g. windshields. In general, the container includes a wirebound crate having side walls, a cover, and a base having a pair of spaced slotted logs secured thereon. A pair of paperboard stabilizers each having an adhesive strip are mounted on bottom edge portions of each windshield as loaded and biased against the windshield by pins. The bottom edge of the mounted stabilizers has a grooved center portion that is mounted in a slot of the log. Longitudinal motion of the windshield is reduced by (1) the adhesive strip maintaining the stabilizer on bottom edge portions of the windshield and (2) the interlocking of the stabilizer and groove.

Although the stabilizers taught in the above-mentioned patents are acceptable there are limitations. For example, the windshields should be dust free because a dust film on the windshield reduces adhesion of the stabilizers to the windshield which may result in longitudinal motion of the windshield during handling of the container. Another limitation is the additional costly step of removing the residue of the adhesive strip from the windshield.

U.S. patent application Ser. No. 36,882 filed on May 7, 1979 in the name of J. P. Lastik for "Securing Pads for Sheet Shipping Containers" teaches the mounting of a pair of spaced compressible polyurethane pads around bottom edge portions of the windshield as loaded and thereafter positioning the polyurethane pad and windshield portion in a slot of a slotted log. The slot of the log and pad are sized so as to apply a compressive force on the windshield portion to prevent longitudinal motion of the windshield during handling and/or shipping of the loaded container. Although the polyurethane pads are acceptable, elimination of the pads would result in lower material costs.

SUMMARY OF THE INVENTION

This invention relates to a sheet retaining and supporting log for a sheet shipping container. The log includes an elongated member having a longitudinally extending sheet edge supporting surface alongside a row of spaced upright members forming a plurality of sheet edge receiving recesses generally transverse to a longitudinal axis of the member. A strip having an adhesive surface is secured on the sheet edge supporting surface with the adhesive surface facing away from the supporting surface.

This invention also relates to a spacer assembly for separating a plurality of sheets e.g. automotive windshields. The spacer assembly includes a plurality of spacers, each having a pair of spaced members forming a recess therebetween for receiving edge portions of the sheets. Facilities mounting the spacers align the spacers relative to one another.

The invention further relates to a sheet shipping container having a pair of the sheet retaining and supporting logs mounted on the base in spaced relation to one another for supporting bottom edge portions of the sheets and the spacer assembly mounted on top edge portions of the sheets. Facilities are provided e.g. a strap for securing the sheets in a vertical position and biased toward the logs to maintain bottom edge portions of the sheet in continuous contact with the adhesive surface of the strip to prevent longitudinal motion of the windshields.

Still further, this invention relates to a method of securing sheets in a container having a base and a backwall and includes the steps of mounting the sheets in a generally vertical position in the container with edge portions of the sheets supported on the base and urging the sheets toward the base while adhesively engaging edge portions of the sheets supported by the base.

DETAILED DESCRIPTION OF THE INVENTION

Figure 1:
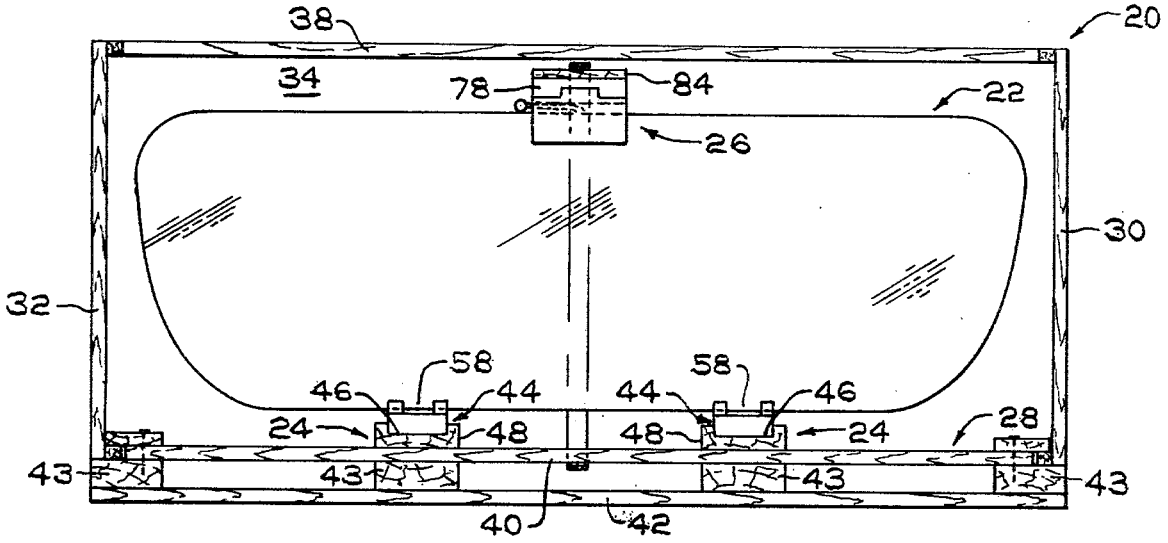
FIG. 1 is a front elevated view of a sheet shipping container incorporating features of the invention loaded with automotive windshields in accordance with the teachings of the invention and having the front panel removed to illustrate the interior of the container.
Figure 2:
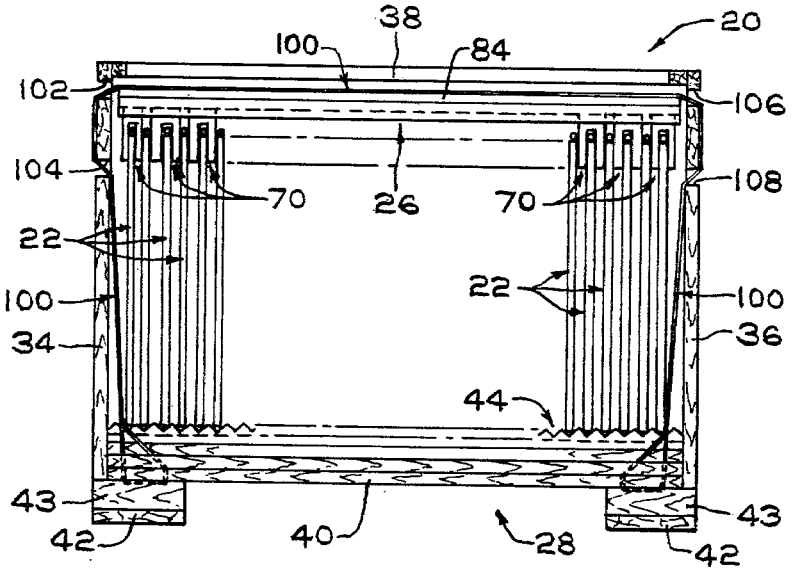
FIG. 2 is a side elevated view of the container shown in FIG. 1 showing the front panel and having a side panel removed to illustrate the interior of the container.

In FIGS. 1 and 2 there is shown a sheet shipping and/or handling container 20 having a plurality of sheets 22 mounted therein in spaced relation to one another by bottom slotted log assemblies or bottom slotted elongated members 24 and upper spacer assembly 26 in accordance with the teachings of the invention. In general, the container 20 includes a base 28, side panels 30 and 32, back panel 34, a front panel 36 shown only in FIG. 2 and a lid or cover 38. The base preferably includes upper rigid support 40 conveniently spaced from a lower rigid support 42 by spacer blocks 43 to provide a space for lifting the loaded container by a fork lift (not shown). The container panels 30, 32, 34 and 36 and cover 38 may be made of spaced wooden slats of the type used in wirebound containers or may be pressed corrugated fiberboard.

Figure 3:
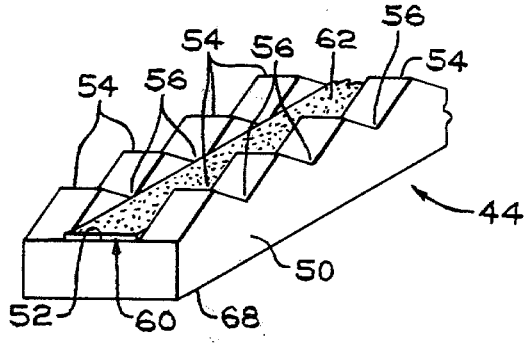
FIG. 3 is a partial isometric view of a slotted sheet supporting log of the instant invention.

With specific reference to FIG. 1, each of the bottom slotted log assemblies 24 include a slotted log 44 conveniently secured in channel 46 of log support 48 e.g. nailed therein. The log support 48 in turn is secured on the base 28 to prevent longitudinal reciprocal movement of the slotted log 44, i.e. reciprocal movement between the side panels 30 and 32 and lateral reciprocal movement. With reference to FIG. 3, each of the slotted logs 44 includes an elongated member 50 having a longitudinally extending sheet edge supporting surface 52 preferably aligned with the longitudinal axis of the elongated member 40. The sheet edge supporting surface 52 has a row of spaced uprights or members 54 forming a plurality of recesses 56 having their major axis generally transverse to the longitudinal axis of the member 50 for receiving bottom edge portions 58 (see FIG. 1) of the sheets 22 as stacked and for spacing the sheets 22 from one another. A strip 60 having an adhesive layer 62 is conveniently secured on the sheet edge supporting surface 52 of the log 44 with the adhesive layer 62 facing away from the sheet supporting surface 52. The sheets are biased toward the slotted log 44 to continuously urge the bottom sheet edge portions against the adhesive layer in a manner to be discussed below to prevent longitudinal motion of the sheet.

Figure 4:
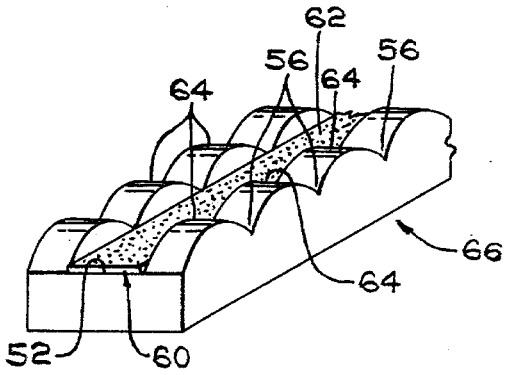
FIG. 4 is a view similar to FIG. 2 illustrating an alternate embodiment of the invention.

As can now be appreciated the invention is not limited to the shape of the uprights 54. For example the uprights 54 may have a serrated configuration as shown in FIG. 3 for the slotted log 44 or may have a scalloped configuration as shown in FIG. 4 for uprights 64 of slotted log 66.

The slotted log 44 may be made of any material, for example but not limited to, wood, corrugated fiberboard and polystyrene. The depth of the recesses 56 relative to the adhesive surface 62 of the strip 60 depends on the compressibility of the material of the log in order that the adhesive surface 62 of the strip 60 contacts the bottom edge portions of the sheet. For example, if the material is easily compressible, the recesses 56 may terminate short of the adhesive surface 62 whereas if the material is not easily compressible, the recesses 56 preferably terminate below the adhesive surface 62 of the strip 60.

Slotted logs 44 for shipping curved automotive windshields have been constructed from a rectangular shaped block of expanded polystyrene compressed to about a 3 pound (1.4 kilograms) density. The block has a length of about 28 inches (0.7 meters), a width of about 3 inches (7.62 centimeters) and a height of about $2\frac{1}{2}$ inches (6.35 centimeters). A sheet supporting surface 52 having a width of about 1 inch (2.54 centimeters), a length of about 28 inches (0.7 meters) and about 1.5 inches (3.81 centimeters) from the bottom surface 68 as shown in FIG. 3 was cut in the block. On each side of the sheet receiving surface 52 there was cut a row of serrated uprights having a height of about 1 inch (2.54 centimeters) and a base width of about 1 inch (2.54 centimeters) to provide grooves 56 having about a 1 inch (2.54 centimeter) depth. The groove 56 at one end is spaced about 2 inches (5.08 centimeters) from its adjacent end and the groove 56 at the opposite end is spaced about 5.25 inches (13.33 centimeters) from its adjacent end to maintain the ends of the innermost and outermost curved windshields as loaded spaced from the back panel 34 and front panel 36, respectively, of the container 20. Double surface adhesive tape of the type sold by Borden, Inc. under the trademark MYSTIK TAPE® was mounted on the sheet receiving surface 52 of the log 44.

With reference to FIGS. 1 and 2, the polystyrene slotted logs 44 discussed above were nailed in the channel 45 of the wood member 46 previously nailed to the base 28 of the container 20. The cover of the top adhesive surface of the strip was removed and sheets 22, i.e. curved automotive windshields were mounted on the slotted logs 44 with bottom edge sheet portions 58 in the recesses 56 to space the windshields at their bottom edges. A spacer 70 shown in FIGS. 5 and 6 is mounted on upper edge portion of alternate windshields as loaded to maintain the upper edge portion of the windshields spaced from one another.

Figure 5:
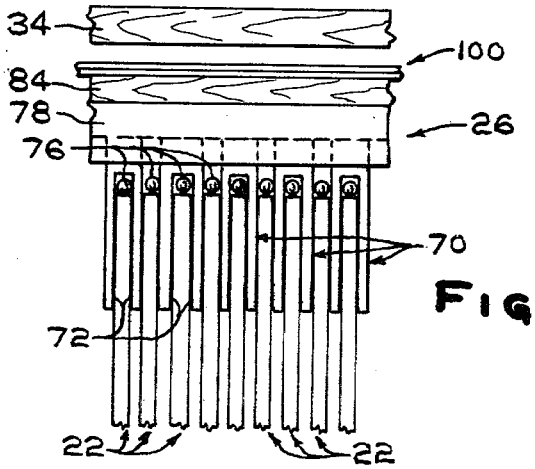
FIG. 5 is a fragmented side view of the top portion of a plurality of windshields as loaded in the container to illustrate the spacer assembly of the invention.
Figure 6:
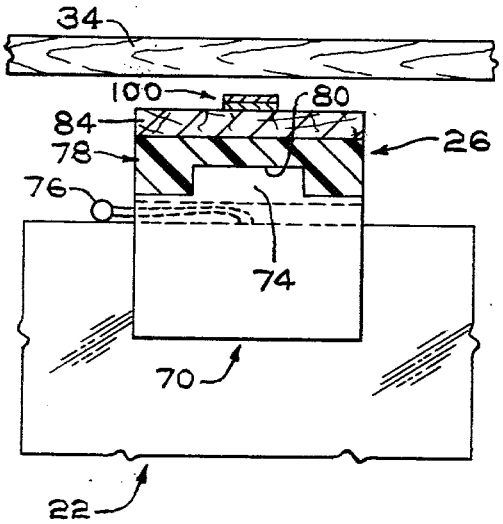
FIG. 6 is a front view of the view in FIG. 5.

With continued reference to FIGS. 5 and 6, there are shown the spacers 70 preferably used for shipping windshields having an antenna. In general, the spacers 70 were cut from a block of expanded polystyrene compressed to about 1.5 pounds density (0.7 kilograms) having a length of about 4.5 inches (11.43 centimeters), a height of about 4.5 inches (11.43 centimeters) and a thickness of about $1\frac{1}{2}$ inches (3.82 centimeters). A groove 72 for receiving the windshield having a length of about 4.5 inches (11.43 centimeters), a width of about $\frac{1}{4}$ inch (0.64 centimeters) and a height of about 3.5 inches (8.89 centimeters) was cut in the block. With reference to FIG. 5, a centrally located tab portion 74 having a height of about 1 inch (2.54 centimeter), a length of about 2 inches (5.08 centimeters) and a thickness of about $1\frac{1}{2}$ inches (3.82 centimeters) is cut in the block. The spacer 70 is mounted on the upper edge portion of the windshield 22 as shown in FIG. 5 with the tab portion 74 protecting the external antenna connector 76. The spacers 70 are maintained in alignment by an intermediate member 78, e.g. made by polystyrene having a longitudinal groove 80 for receiving the tabs 74. The intermediate member 78 is structurally reinforced by a rigid member 84 e.g. wood member to provide the upper spacer assembly 26.

The spacer 70 on the innermost and outermost windshields are sized for curved windshields to maintain their ends away from the back panel 34 and front panel 36 respectively of the container 20.

Figure 7:
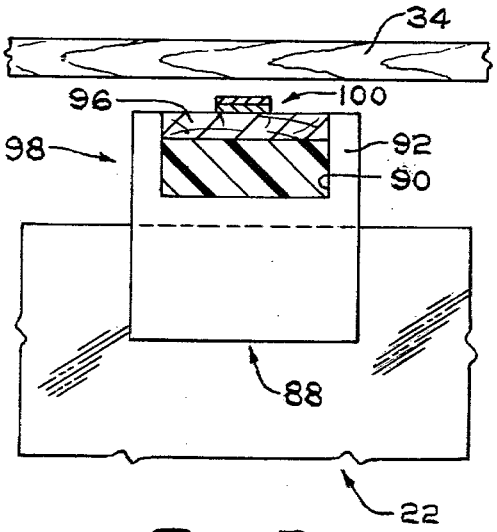
FIG. 7 is a view similar to FIG. 6 illustrating an alternate embodiment of a spacer assembly incorporating features of the invention.

Shown in FIG. 7 is an alternate embodiment of a spacer 88 incorporating features of the invention. The spacer 88 is similar to the spacer 70 of FIGS. 5 and 6 except that the spacer 88 has a centrally located groove 90 having a depth of about 1 inch (2.54 centimeter) and a length of 3.25 inches (8.25 centimeters) in place of the tab portion 74. The spacers 8 are aligned by an intermediate member 92, e.g. a polystyrene member insertable in the groove 90 of the spacers 88. A rigid member 96, e.g. a wood block overlaying the intermediate member 92 completes upper spacer lock assembly 98.

The intermediate members 78 and 92 and rigid members 84 and 96 of the spacer assemblies 26 and 98 maintain the spacers 70 and 88 respectively in alignment and on their respective windshield by providing a supporting surface for a strap 100 to be discussed below.

The sheets or windshields 22 are biased against the adhesive surface 62 of the log 44 and secured in the container 20 by the strap 100. The strap 100 may be applied in any convenient manner. For example, and with reference to FIG. 2, the strap 100 has its course from the top of the spacer assembly 26 through a hole 102 in the back panel 34 over a surface portion of the back panel 34 through hole 104 in the back panel 34 and downward to the base 28. The strap 100 goes around a portion of the base 28 and along the previous course through the holes 104 and 102 in the back panel 34 over the spacer assembly 28 and through hole 106 in the front panel 36. The strap 100 passes over outer portion of the front panel 36, through hole 108 in the front panel 36 down to the base 28. The strap 100 goes around a portion of the base 28 and back along the previous course through holes 108 and 106 of the front panel 36. The ends of the strap 100 are biased toward one another and secured (1) to bias the bottom edge portions 58 of the windshields 22 into the recesses 56 of the logs 44 into continuous contact with the adhesive surface 62 of the strip 60 and (2) to compress the windshields together about the spacers.

As can be appreciated the above example is presented for illustration purposes only and is not limiting to the invention. For example, the logs 44 and 66 and the spacers 70 and 88 may be formed instead of cut from a block of polystyrene and a spacer 72 may be mounted on each windshield.

What is claimed is:

1. A shipping container, comprising:

a base;

a plurality of glass sheets having a bottom edge portion and an opposite upper edge portion;

means mounted on said base for supporting bottom edge portion of said sheets, said supporting means includes a pair of sheet supporting and retaining logs, at least one of said logs comprising an elongated member having a longitudinally extending sheet edge supporting surface having an adhesive surface and at least one row of spaced uprights forming sheet edge receiving recesses therebetween, said recesses generally transverse to the longitudinal axis of said member, wherein said sheets have bottom edge portions mounted in selected ones of the sheet edge receiving recesses to space adjacent sheets; and means mounting said upper edge of said sheets for biasing said sheets against said adhesive surface to minimize motion of said sheets along a path transverse to the longitudinal axis of said member.

2. The container as set forth in claim 1 wherein the at least one row of spaced uprights in a first row and further including:

a second row of spaced uprights having sheet edge receiving recesses therebetween, said recesses of said second row of spaced uprights generally transverse to the longitudinal axis of said member; and said adhesive surface between said first and second rows of spaced uprights.

3. The container as set forth in claim 2 wherein said first and second rows of spaced uprights as viewed at the side thereof have a serrated configuration.

4. The container as set forth in claim 2 wherein said first and second rows of spaced uprights as viewed at the side thereof have a scalloped configuration.

5. The container as set forth in claim 2 wherein the bottom of said recesses are at or below the plane of said adhesive surface.

6. The container as set forth in claim 2 wherein said elongated member is made of a compressible material and the bottom of the recesses are above the plane of said adhesive surface.

7. The container as set forth in claim 2 wherein said adhesive surface is a surface of a tape, said tape further having adhesive on opposed surface of said tape.

8. The container as set forth in claims 1, 2, 3, 4, 5 or 7 wherein said elongated member is made of a compressible material.

9. The container as set forth in claims 1, 2, 3, 4, 5, 6 or 7 further including means for securing the sheets in a generally vertical position with bottom sheet edge portions on said supporting means.

10. The container as set forth in claim 9 wherein said elongated member is made of a compressible material.

11. The container as set forth in claim 9 wherein the securing means includes a spacer assembly and said spacer assembly comprises:

a spacer having a pair of spaced members forming a recess therebetween for receiving upper sheet edge portions, said spacer mounted on selected sheets; and means mounting said spacers for aligning said spacers.

12. The container as set forth in claim 11 wherein each of said spacers of said spacer assembly has a tab portion opposite to and extending away from the recess and the aligning means includes an elongated member having a channel for receiving tab portions of said spacers.

13. The container as set forth in claim 11 wherein the recess of said spacer is a first recess and further including a second recess facing a direction opposite to the direction of the first recess and said aligning means includes an elongated member mountable in the second recess of said spacers.

14. The container as set forth in claim 11 wherein said sheet supporting means includes a pair of elongated members, each of said elongated members comprising:

an elongated member having an adhesive surface between a pair of spaced uprights forming sheet receiving recesses generally transverse to the longitudinal axis of said member.

15. The container as set forth in claim 14 wherein the sheets are automotive lites.

* * * * *

UNITED STATES PATENT AND TRADEMARK OFFICE

CERTIFICATE OF CORRECTION

PATENT NO. : 4,353,466

DATED : October 12, 1982

INVENTOR(S) : Walter E. Pater

It is certified that error appears in the above-identified patent and that said Letters Patent are hereby corrected as shown below:

Column 5, line 36, "in" should be --is--.

Signed and Sealed this

*Eleventh* Day of *January 1983*

[SEAL]

*Attest:*

GERALD J MOSSINGHOFF

*Attesting Officer*

*Commissioner of Patents and Trademarks*